US008713954B2

(12) United States Patent
Stephens et al.

(10) Patent No.: US 8,713,954 B2
(45) Date of Patent: May 6, 2014

(54) AIR CURTAIN SYSTEM FOR AN OPEN-FRONT REFRIGERATED CASE WITH DUAL TEMPERATURE ZONES

(75) Inventors: Arnold M. Stephens, Powhatan, VA (US); Donald T. Torgerson, Bloomfield, IA (US)

(73) Assignee: Hill Phoenix, Inc., Conyers, GA (US)

( * ) Notice: Subject to any disclaimer, the term of this patent is extended or adjusted under 35 U.S.C. 154(b) by 319 days.

(21) Appl. No.: 13/213,535

(22) Filed: Aug. 19, 2011

(65) Prior Publication Data

US 2012/0042675 A1 Feb. 23, 2012

Related U.S. Application Data

(60) Provisional application No. 61/376,152, filed on Aug. 23, 2010.

(51) Int. Cl.
*A47F 3/04* (2006.01)

(52) U.S. Cl.
USPC ..... 62/256

(58) Field of Classification Search
USPC ..... 62/254, 256, 247, 248, 426
See application file for complete search history.

(56) References Cited

U.S. PATENT DOCUMENTS 3,229,475 A * 1/1966 Balk et al. ..... 62/256
3,304,736 A * 2/1967 Brennan et al. ..... 62/176.1
3,369,375 A * 2/1968 Gerweck et al. ..... 62/256
4,329,852 A * 5/1982 Ibrahim et al. ..... 62/256
5,345,778 A * 9/1994 Roberts ..... 62/256
5,357,767 A * 10/1994 Roberts ..... 62/256
5,675,983 A 10/1997 Ibrahim
6,912,864 B2 7/2005 Roche et al.
6,959,560 B2 11/2005 Weikel et al.
7,681,409 B2 3/2010 Alahyari et al.
7,975,492 B2 7/2011 Alahyari
2009/0215381 A1 8/2009 Swofford
2009/0255287 A1 10/2009 Alahyari et al.
2010/0058789 A1 3/2010 Barreto et al.
2010/0192600 A1 8/2010 Schenk et al.
2010/0199696 A1 8/2010 Nagel et al.
2010/0212343 A1 8/2010 Swofford et al.
2010/0313588 A1 12/2010 Swofford et al.
2011/0259030 A1 10/2011 Anderson et al.
2011/0259031 A1 10/2011 Anderson et al.

OTHER PUBLICATIONS

U.S. Appl. No. 13/105,703, filed May 11, 2011, Howington et al.

* cited by examiner

*Primary Examiner* — Melvin Jones
(74) *Attorney, Agent, or Firm* — Foley & Lardner LLP

(57) ABSTRACT

An open-front refrigerated display case is provided having a medium temperature zone disposed above a low temperature zone in a generally vertically-stacked arrangement. A spill-over airflow-diverting device is disposed between the medium temperature zone and the low temperature zone and is configured to direct spillover air from the medium temperature zone air curtain (and ambient air entrained therewith) in a direction away from the open front of the low temperature zone. The spillover airflow-diverting device may include louvers configured to direct a gravity-induced flow of the spill-over air in an outward direction away from the open front of the low temperature zone, or may include fans to collect spillover air and forcibly direct it in an outward direction away from the open front of the low temperature zone. The outwardly directed spillover air may be discharged in the form of an 'outer layer' for an air curtain on the low temperature zone.

14 Claims, 6 Drawing Sheets

AIR CURTAIN SYSTEM FOR AN OPEN-FRONT REFRIGERATED CASE WITH DUAL TEMPERATURE ZONES

CROSS-REFERENCE TO RELATED APPLICATIONS

The present application claims the benefit of priority under 35 U.S.C. §119(e)(1) of U.S. Provisional Patent Application No. 61/376,152, titled "Air Curtain System for an Open-Front Refrigerated Case with Dual Temperature Zones" and filed on Aug. 23, 2010, the disclosure of which is incorporated herein by reference in its entirety.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

The present invention relates generally to the field of temperature-controlled display devices (e.g. refrigerated cases, etc.) having a temperature-controlled space for storing and displaying refrigerated objects. More specifically, the present invention relates to a refrigerated case having two separate temperature-controlled spaces or zones for storing and displaying objects having different temperature requirements. Still more specifically, the present invention relates to an open-front type refrigerated case having a medium temperature (e.g. refrigerator) zone disposed in a vertically-stacked arrangement above a low temperature (e.g. freezer) zone. More specifically still, the present invention relates to an improved air curtain system for an open-front type refrigerated case having a medium temperature zone disposed above a low temperature zone.

It is well known to provide a temperature controlled display device such as a refrigerator, freezer, refrigerated merchandiser, refrigerated display case, etc., that may be used in commercial, institutional, and residential applications for storing or displaying refrigerated or frozen objects. For example, it is known to provide service type refrigerated display cases for displaying fresh food products such as beef, pork, poultry, fish, etc. Such display cases have a closed front (e.g. with doors for accessing food products stored within the temperature controlled space), or may have an open-front that uses a flow of chilled air that is discharged across the open front of the case to help maintain a desired temperature within the temperature-controlled space. Such open-front cases may also be provided as a dual-temperature zone case with a medium temperature zone separate from and disposed above a low temperature zone to facilitate storage and display of food products having different temperature requirements at the same general location. However, these known refrigerated cases with vertically-stacked dual temperature zones present a number of disadvantages. For example, a portion of the air curtain on the medium temperature zone tends to spill over the bottom of the medium temperature zone and down into the low temperature zone. The introduction of the relatively warmer air from the medium temperature air curtain (and ambient air entrained therewith) into the temperature-controlled space of the low temperature zone tends to reduce the thermal performance and efficiency of the low temperature zone and cause other adverse consequences (e.g. condensation of moisture from the ambient environment, more frequent frosting and the need to increase the frequency of defrosting the low temperature zone, etc.).

Accordingly, it would be desirable to provide an open-front refrigerated display case having vertically-stacked dual-temperature zones with an improved air curtain system that overcomes these and other disadvantages.

SUMMARY

One embodiment of the invention relates to a temperature-controlled display device, such as an open-front refrigerated display case, having a medium temperature zone disposed above a low temperature zone in a generally vertically-stacked arrangement.

The medium temperature zone defines a first (e.g. upper, medium temperature) temperature-controlled space having a first, medium temperature, air curtain arranged to flow downwardly across the open front of the upper temperature controlled space. The medium temperature zone also includes a first fan configured to draw at least a portion of the air from the first air curtain through a first intake and across a first (medium temperature) cooling coil and thorough a first (medium temperature) flow path (e.g. duct, passageway, etc.) for discharge through a first outlet to maintain operation of the first air curtain.

The low temperature zone defines a second (e.g. lower, low temperature) temperature-controlled space having a second, low temperature, air curtain arranged to flow downwardly across the open front of the lower temperature controlled space. The low temperature zone also includes a second fan configured to draw at least a portion of the air from the second air curtain through a second intake and across a second (low temperature) cooling coil and thorough a second (low temperature) flow path (e.g. duct, passageway, etc.) for discharge through a second outlet to maintain operation of the second air curtain.

The open-front refrigerated display case further includes a spillover airflow-diverting device disposed between the medium temperature zone and the low temperature zone. The spillover airflow-diverting device is configured to direct air from the first air curtain (and ambient air entrained therewith) that is not drawn into the first intake (e.g. spillover air, etc.) in a direction away from the open front of the low temperature zone. The spillover airflow-diverting device may include louvers (e.g. vanes, etc.) configured to direct a gravity-induced flow of the spillover air in an outward direction away from the open front of the low temperature zone.

Alternatively, the spillover airflow-diverting device may include one or more third fans (e.g. blowers, etc.) configured to collect spillover air from the first air curtain and direct it in an outward direction away from the open front of the low temperature zone.

According to another alternative, the third fans are configured to collect the spillover air from the first air curtain and discharge the spillover air in the form of an 'outer layer' for the second air curtain on the low temperature zone.

According to yet another alternative, the third fans may collect the spillover air from the first air curtain and direct it across the first (medium temperature) cooling coil and thorough the first (medium temperature) flow path for discharge through the first outlet to maintain operation of the first air curtain.

All of these spillover airflow-diverting alternatives are intended to provide an improved air curtain system that provides enhanced thermal performance of the open-front dual temperature zone refrigerated case by reducing the introduction of relatively warmer air from the upper medium temperature zone (and adjacent ambient air) into the temperature-controlled space of the low temperature zone.

BRIEF DESCRIPTION OF THE DRAWINGS

Exemplary embodiments will hereafter be described with reference to the accompanying drawings, wherein like numerals denote like elements.

DETAILED DESCRIPTION

Figure 1:
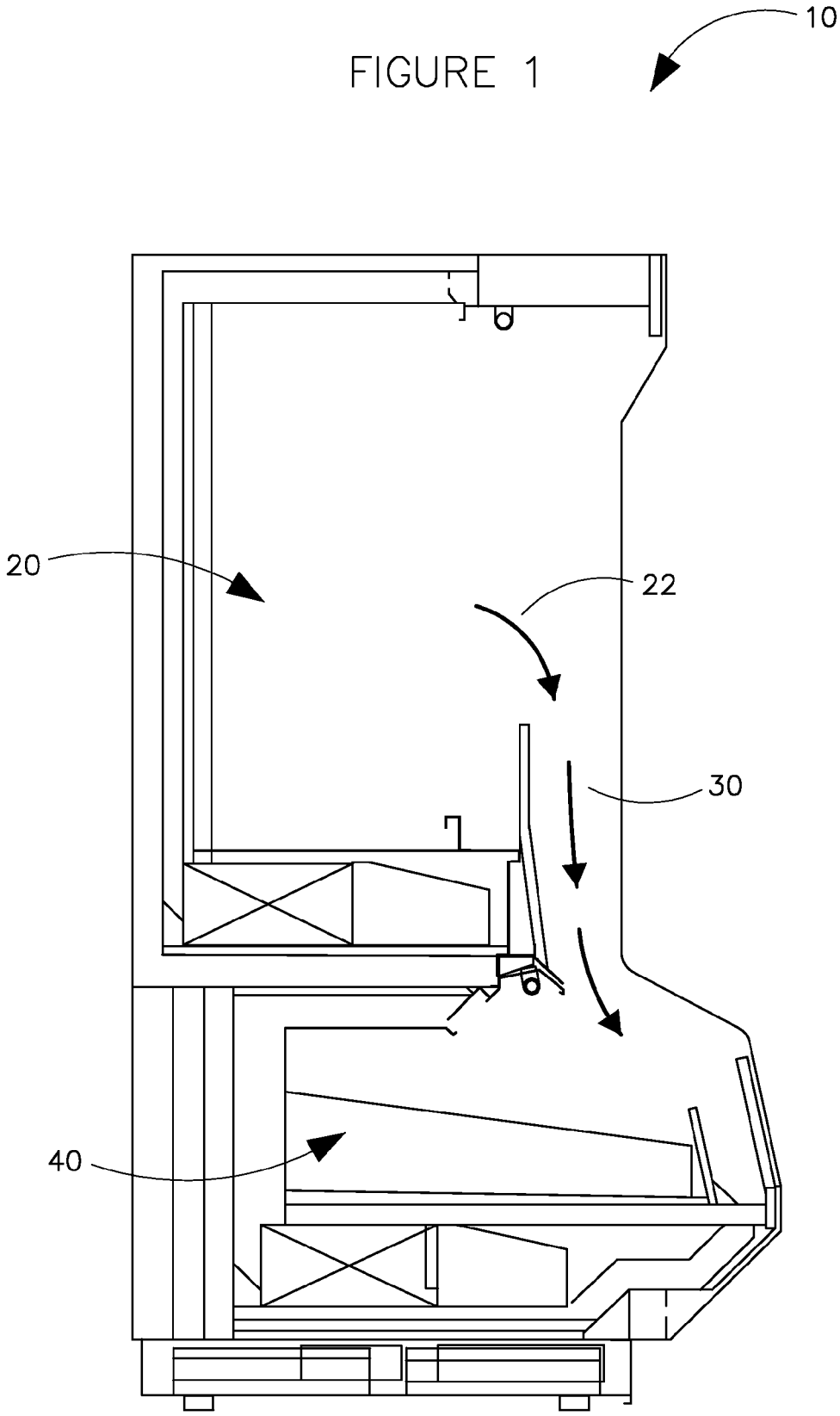
FIG. 1 is an schematic image of a side elevation view of a prior art temperature controlled display device having a vertically-stacked medium temperature zone arranged above a low temperature zone.

Referring to FIG. 1, a prior art open-front dual temperature zone refrigerated case 10 is shown having a medium temperature zone 20 arranged in a generally vertically-stacked arrangement above a low temperature zone 40. Spillover air 30 from a medium temperature air curtain 22 typically flow over a front portion of the case 10 and into the low temperature zone 40, which tends to reduce the thermal performance and energy efficiency of the case 10.

Figure 2:
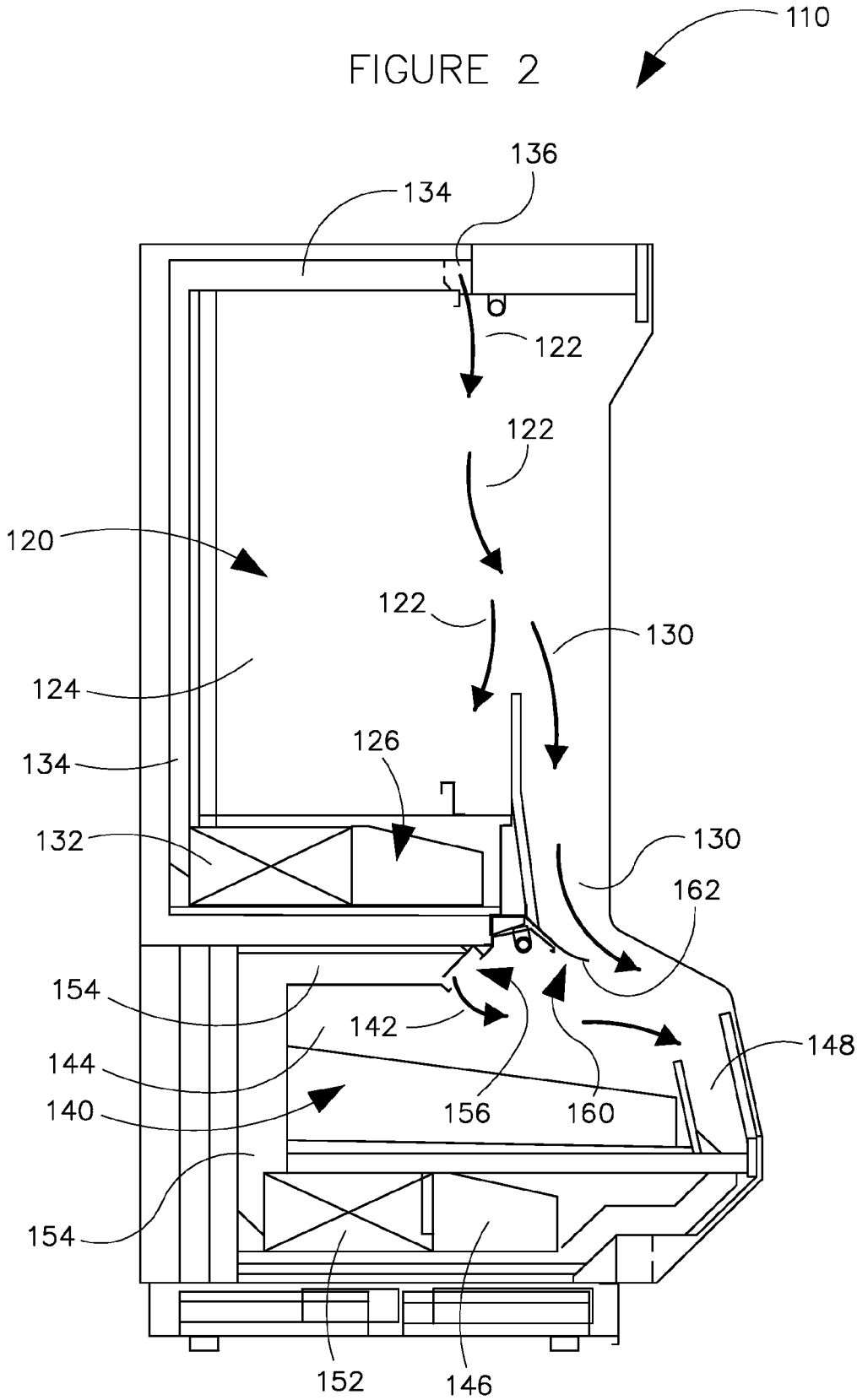
FIG. 2 is a schematic image of a side elevation view of an open-front refrigerated display case having a vertically-stacked medium temperature zone arranged above a low temperature zone and a spillover airflow-diverting device for an improved air curtain system according to an exemplary embodiment.

Referring to FIG. 2 a temperature controlled display device (shown for example as an open-front, dual temperature zone refrigerated case 110) with a spillover airflow diverting device 160 is shown according to an exemplary embodiment. The dual temperature zones are shown as a medium temperature zone 120 arranged in a generally vertically stacked arrangement above a low temperature zone 140. The medium temperature zone 120 defines a first (e.g. upper, medium temperature) temperature-controlled space 124 having a first, medium temperature, air curtain 122 arranged to flow downwardly across the open front of the upper temperature controlled space 124. The medium temperature zone also includes a first fan 126 configured to draw at least a portion of the air from the first air curtain 122 through a first intake 128 and across a first (medium temperature) cooling coil 132 and through a first (medium temperature) flow path 134 (e.g. duct, passageway, etc.) for discharge through a first outlet 136 to maintain operation of the first air curtain 122.

The low temperature zone 140 defines a second (e.g. lower, low temperature) temperature-controlled space 144. The space 144 may be configured with a generally horizontal opening, such as in the manner of a 'coffin' type cooler, which typically relies on the heavier weight of the chilled air to remain within the space 144, and avoids the use of an air curtain. According to another embodiment (as shown in FIG. 2), the open front of the low temperature zone may be angled or sloped, and may include a second, low temperature, air curtain 142 arranged to flow downwardly across the open front of the lower temperature controlled space 144. The low temperature zone 140 also includes a second fan 146 configured to draw at least a portion of the air from the second air curtain 142 through a second intake 148 and across a second (low temperature) cooling coil 152 and thorough a second (low temperature) flow path 154 (e.g. duct, passageway, etc.) for discharge through a second outlet 156 to maintain operation of the second air curtain 142.

The open-front refrigerated display case 110 further includes a spillover airflow-diverting device 160 shown as disposed generally between the medium temperature zone 120 and the low temperature zone 140, according to one embodiment. The spillover airflow-diverting device 160 as shown by way of example in FIG. 2 is intended to operate as a gravity-induced airflow diverting device that is configured to direct air from the first air curtain 122 (and ambient air entrained therewith) that is not drawn into the first intake 128 (e.g. spillover air, etc.) in a direction intended to prevent it from entering the open front of the low temperature zone 140. According to one embodiment, the spillover airflow-diverting device 160 includes louvers 162 (e.g. vanes, etc.) configured to direct a gravity-induced flow of the spillover air 130 in an outward direction that forms another (outer) layer air curtain 164 along the second low temperature air curtain 142 along the open front of the low temperature zone 140, where it is then returned into the second intake 148 and then across the second (low temperature) cooling coil 152. According to an alternative embodiment, the outer layer air curtain 164 may be intentionally configured to spillover the front of the low temperature zone 140, in order to reduce the cooling load on the second cooling coil 152 that would otherwise be associated with chilling the warmer air from the outer layer air curtain.

The louvers 162 may have any suitable shape (e.g. straight, curved, etc.) and project outwardly at any desired angle to create an outer layer air curtain having the desired profile for return into the second intake, or for spilling over the front of the low temperature zone.

Figure 3A:
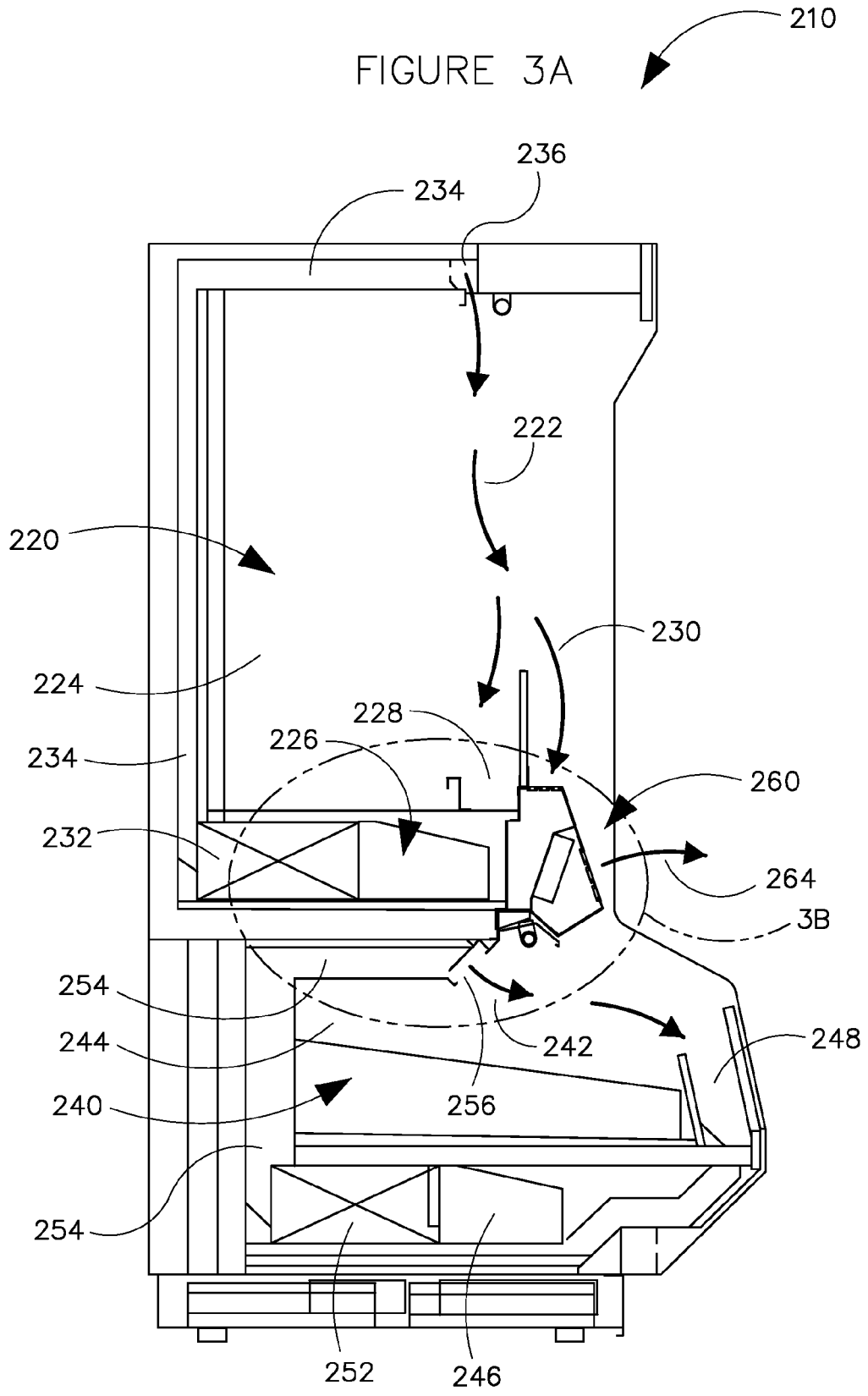
FIG. 3A is a schematic image of a side elevation view of an open-front refrigerated display case having a vertically-stacked medium temperature zone arranged above a low temperature zone and a spillover airflow-diverting device for an improved air curtain system according to another exemplary embodiment.
Figure 3B:
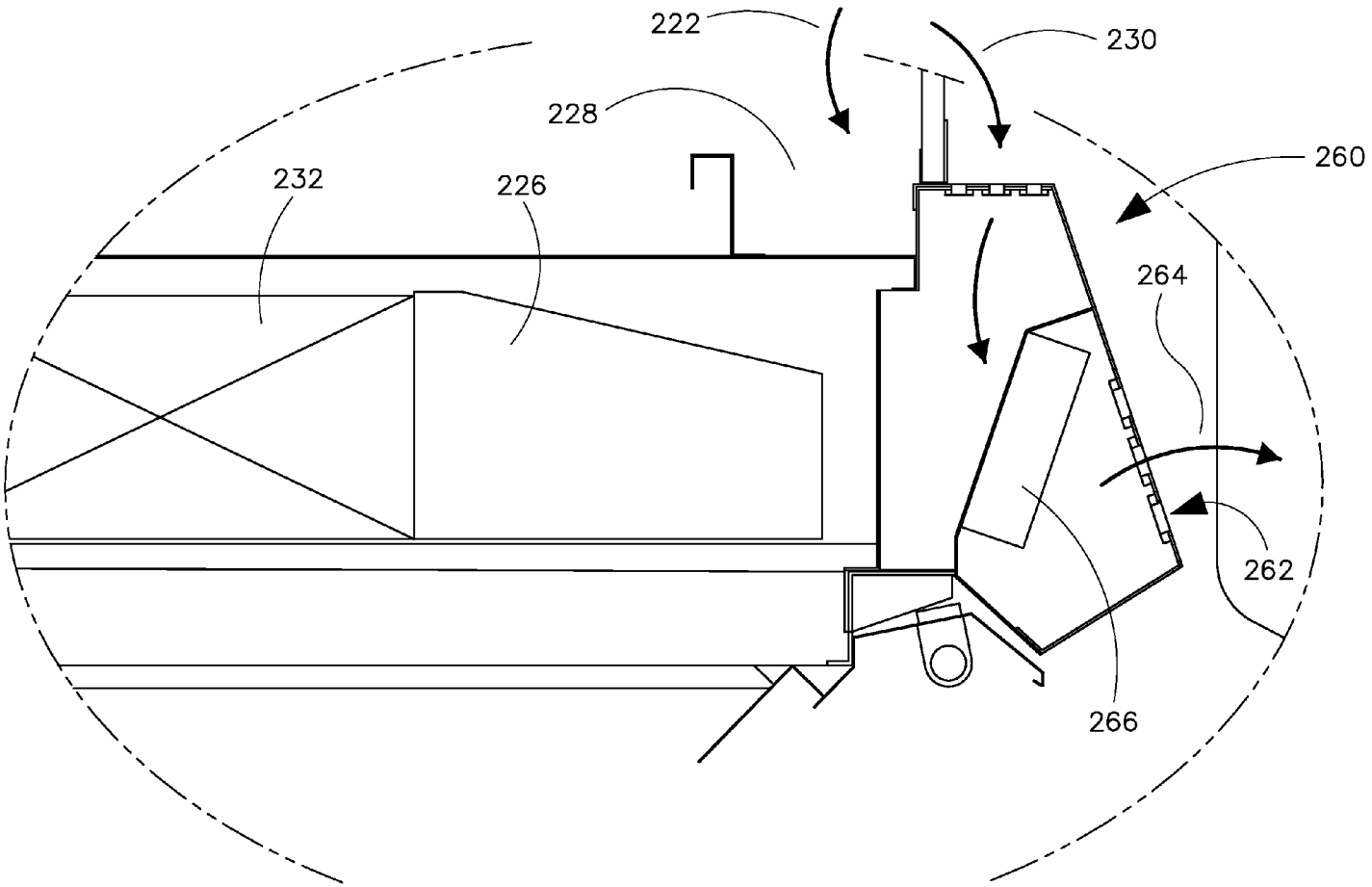
FIG. 3B is a schematic image of a detailed portion of the flow-diverting device of FIG. 3A according to an exemplary embodiment.

Referring to FIGS. 3A and 3B a temperature controlled display device (shown for example as an open-front, dual temperature zone refrigerated case 210) with a spillover airflow diverting device 260 is shown according to another exemplary embodiment. The dual temperature zones are shown as a medium temperature zone 220 arranged in a generally vertically stacked arrangement above a low temperature zone 240. The medium temperature zone 220 defines a first (e.g. upper, medium temperature) temperature-controlled space 224 having a first, medium temperature, air curtain 222 arranged to flow downwardly across the open front of the upper temperature controlled space 224. The medium temperature zone 220 also includes a first fan 226 configured to draw at least a portion of the air from the first air curtain 222 through a first intake 228 and across a first (medium temperature) cooling coil 232 and thorough a first (medium temperature) flow path 234 (e.g. duct, passageway, etc.) for discharge through a first outlet 236 to maintain operation of the first air curtain 222.

The low temperature zone 240 defines a second (e.g. lower, low temperature) temperature-controlled space 244. The space may be configured with a generally horizontal opening, such as in the manner of a 'coffin' type cooler, which typically relies on the heavier weight of the chilled air to remain within the space 244, and avoids the use of an air curtain. According to another embodiment (as shown in FIG. 3A), the open front of the low temperature zone 240 may be angled or sloped, and may include a second, low temperature, air curtain 242 arranged to flow downwardly across the open front of the lower temperature controlled space 244. The low temperature zone 240 also includes a second fan 246 configured to draw at least a portion of the air from the second air curtain 242 through a second intake 248 and across a second (low temperature) cooling coil 252 and through a second (low temperature) flow path 254 (e.g. duct, passageway, etc.) for discharge through a second outlet 256 to maintain operation of the second air curtain 242.

The open-front refrigerated display case 210 further includes a spillover airflow-diverting device 260 shown as disposed generally between the medium temperature zone 220 and the low temperature zone 240, according to another embodiment. The spillover airflow-diverting device 260 as shown by way of example in FIGS. 3A & 3B is intended to operate as a forced airflow diverting device that is configured to direct air from the first air curtain 222 (and ambient air entrained therewith) that is not drawn into the first intake 228 (e.g. spillover air, etc.) in a direction intended to prevent it from entering the open front of the low temperature zone 240.

The spillover airflow-diverting device 260 may include one or more third fans 266 (e.g. blowers, etc.) configured to collect spillover air 230 from the first air curtain 222 and direct it in an outward direction 264 away from the open front of the low temperature zone 240. This embodiment is intended for use in applications where another outer layer air curtain for the low temperature zone is not needed or desired. According to one embodiment, the spillover airflow-diverting device 260 may includes louvers 262 (e.g. vanes, etc.) arranged at the discharge of the third fan 266 and configured to direct a flow of the spillover air in an outward direction 264 away from the open front of the low temperature zone 240.

Figure 4A:
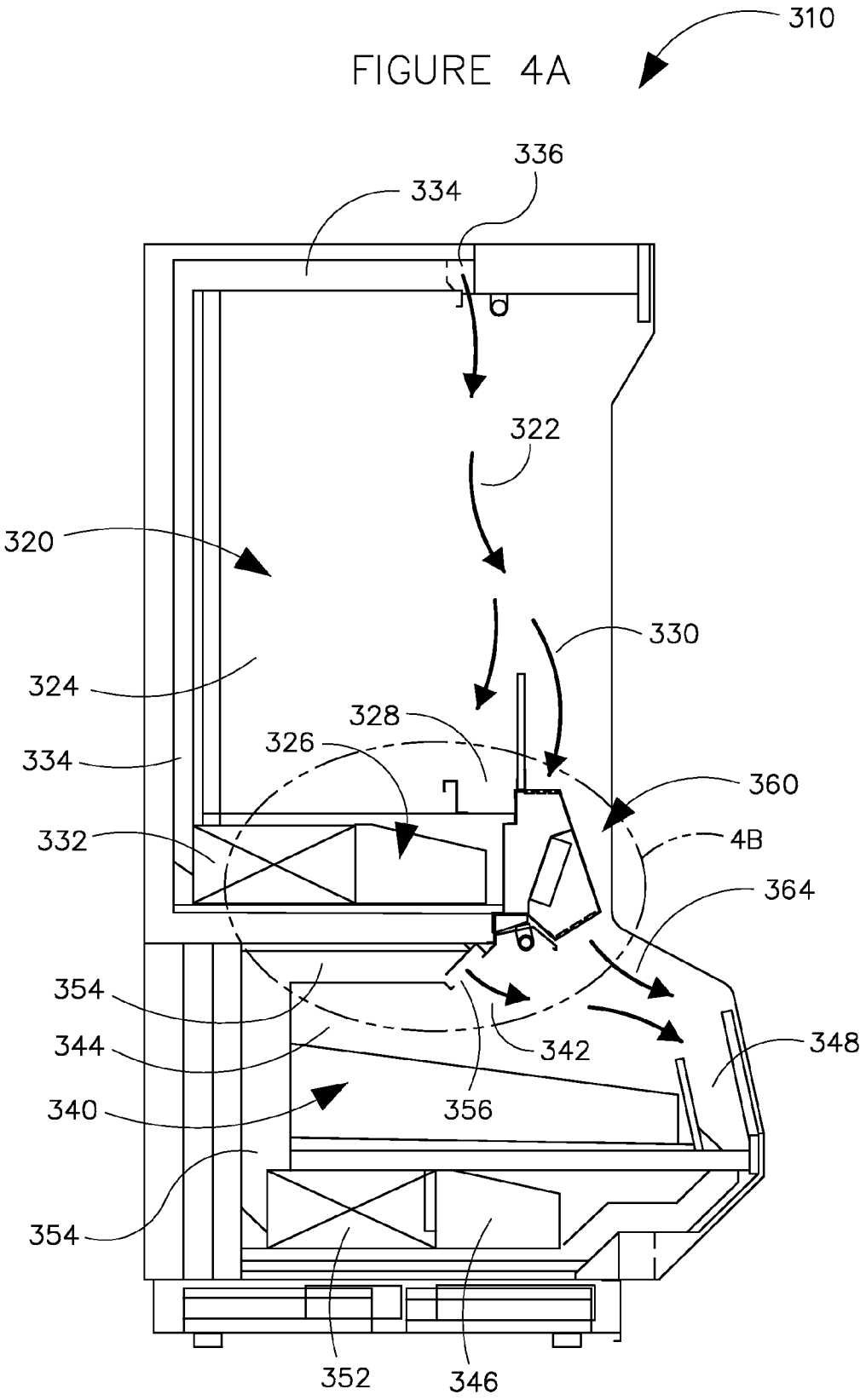
FIG. 4A is a schematic image of a side elevation view of an open-front refrigerated display case having a vertically-stacked medium temperature zone arranged above a low temperature zone and a spillover airflow-diverting device for an improved air curtain system according to yet another exemplary embodiment.
Figure 4B:
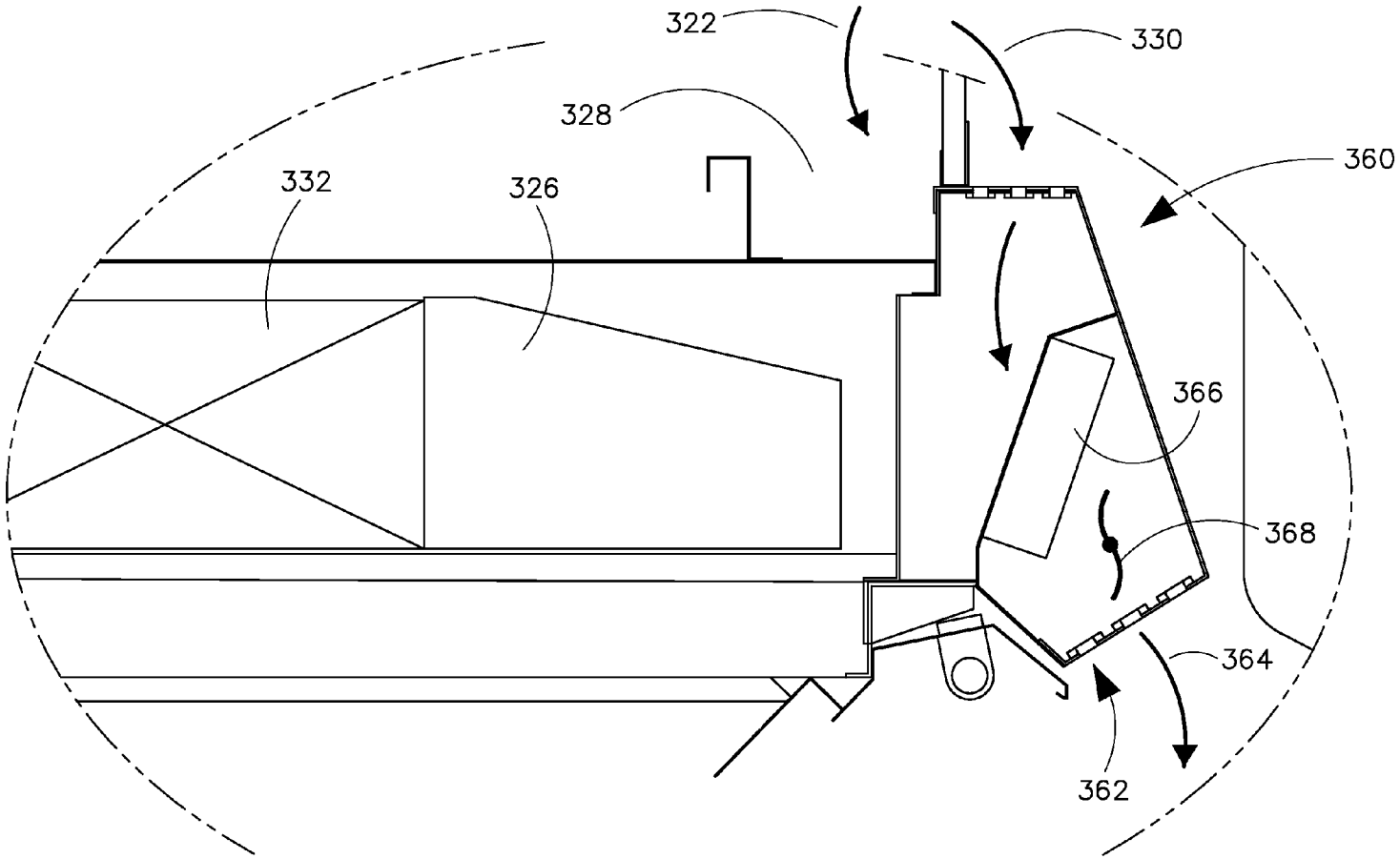
FIG. 4B is a schematic image of a detailed portion of the spillover airflow-diverting device of FIG. 4A according to an exemplary embodiment.

Referring to FIGS. 4A and 4B a temperature controlled display device (shown for example as an open-front, dual temperature zone refrigerated case 310) with a spillover airflow diverting device 360 is shown according to yet another exemplary embodiment. The dual temperature zones are shown as a medium temperature zone 320 arranged in a generally vertically stacked arrangement above a low temperature zone 340. The medium temperature zone 320 defines a first (e.g. upper, medium temperature) temperature-controlled space 224 having a first, medium temperature, air curtain 322 arranged to flow downwardly across the open front of the upper temperature controlled space 324. The medium temperature zone 320 also includes a first fan 326 configured to draw at least a portion of the air from the first air curtain 322 through a first intake 328 and across a first (medium temperature) cooling coil 332 and thorough a first (medium temperature) flow path 334 (e.g. duct, passageway, etc.) for discharge through a first outlet 336 to maintain operation of the first air curtain 322.

The low temperature zone 340 defines a second (e.g. lower, low temperature) temperature-controlled space 344. The space may be configured with a generally horizontal opening, such as in the manner of a 'coffin' type cooler, which typically relies on the heavier weight of the chilled air to remain within the space 344, and avoids the use of an air curtain. According to another embodiment (as shown in FIG. 4A), the open front of the low temperature zone 340 may be angled or sloped, and may include a second, low temperature, air curtain 342 arranged to flow downwardly across the open front of the lower temperature controlled space 344. The low temperature zone 340 also includes a second fan 346 configured to draw at least a portion of the air from the second air curtain 342 through a second intake 348 and across a second (low temperature) cooling coil 352 and through a second (low temperature) flow path 354 (e.g. duct, passageway, etc.) for discharge through a second outlet 356 to maintain operation of the second air curtain 342.

The open-front refrigerated display case 310 further includes a spillover airflow-diverting device 360 shown as disposed generally between the medium temperature zone 320 and the low temperature zone 340, according to another embodiment. The spillover airflow-diverting device 360 as shown by way of example in FIGS. 4A & 4B is intended to operate as a forced airflow diverting device that is configured to direct air from the first air curtain 322 (and ambient air entrained therewith) that is not drawn into the first intake 328 (e.g. spillover air 330, etc.) in a direction intended to prevent it from entering the open front of the low temperature zone 340.

The spillover airflow-diverting device 360 may include one or more third fans 366 (e.g. blowers, etc.) configured to collect spillover air 330 from the first air curtain 322 and direct it in an outward direction for discharge across the open front in form of an 'outer layer' 364 for the second air curtain 342 on the low temperature zone 340.

According to one embodiment, the spillover airflow-diverting device 360 may includes louvers 362 (e.g. vanes, etc.) arranged at the discharge of the third fan 366 and configured to forcibly direct a flow of the spillover air 330 in an outward direction that forms another (outer) layer air curtain 364 along the second low temperature air curtain 342 along the open front of the low temperature zone 340, where it is then returned into the second intake 348 and then across the second (low temperature) cooling coil 352. According to an alternative embodiment, the outer layer air curtain may be intentionally configured to spillover the front of the low temperature zone, in order to reduce the cooling load on the second cooling coil that would otherwise be associated with chilling the warmer air from the outer layer air curtain.

According to an alternative embodiment, the third fan 366 may be configured to direct the spillover air 330 from the first air curtain 322 (and any ambient air entrained therewith) back to the first (medium temperature) cooling coil 332 and thorough the first (medium temperature) flow path 334 (e.g. duct, passageway, etc.) for discharge through the first outlet 336 to "recycle" the spillover air 330 and help maintain operation of the first air curtain 322. In addition, a damper 368 or other suitable device may be provided that permits the spillover airflow device 360 to change its discharge flow direction between a first configuration for creation of the outer layer air curtain 364, and a second configuration that recycles the spillover air 330 back to the first air curtain 322.

According to any exemplary embodiment, the open-front, dual temperature zone refrigerated case spillover includes a spillover airflow-diverting device that is intended to provide an improved air curtain system that enhances the thermal performance of the open-front dual temperature zone refrigerated case by reducing the introduction of relatively warmer air from the upper medium temperature zone (and adjacent ambient air entrained therewith) into the temperature-controlled space of the low temperature zone.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

No claim element herein is to be construed under the provisions of 35 U.S.C. §112, sixth paragraph, unless the element is expressly recited using the phrase "means for." Furthermore, no element, component or method step in the present disclosure is intended to be dedicated to the public, regardless of whether the element, component or method step is explicitly recited in the claims.

It is also important to note that the construction and arrangement of the open-front dual temperature zone refrigerated case with a spillover airflow diverting device as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

What is claimed is:

1. An open-front refrigerated display case, having a medium temperature zone disposed above a low temperature zone in a generally vertically-stacked arrangement, comprising:

a medium temperature-controlled space having a medium temperature air curtain arranged to flow across the open front of the medium temperature controlled space;

a first fan configured to draw at least a portion of the air from the medium temperature air curtain through a first intake and across a medium temperature cooling coil and through a medium temperature flow path for discharge through a first outlet to maintain operation of the medium temperature air curtain;

a low temperature-controlled space having a low temperature air curtain arranged to flow across the open front of the lower temperature-controlled space;

a spillover airflow-diverting device disposed between the medium temperature zone and the low temperature zone, the spillover airflow-diverting device configured to direct spillover air from the medium temperature air curtain in a direction away from the open front of the low temperature zone;

wherein the spillover airflow-diverting device comprises at least one louver configured to direct a gravity-induced flow of the spillover air in an outward direction away from the open front of the low temperature zone.

2. The open-front refrigerated display case of claim 1, wherein the spillover airflow-diverting device includes one or more fans configured to collect spillover air from the medium temperature air curtain and direct it in an outward direction away from the open front of the low temperature zone.

3. The open-front refrigerated display case of claim 1, wherein the spillover airflow-diverting device includes one or more fans configured to collect spillover air from the medium temperature air curtain and direct it over the open front of the low temperature zone as an outer layer air curtain.

4. The open-front refrigerated display case of claim 1, wherein the spillover airflow-diverting device includes one or more fans configured to collect the spillover air from the medium temperature air curtain and direct it across the medium temperature cooling coil and through the medium temperature flow path for discharge through the first outlet to recycle the spillover air and maintain operation of the medium temperature air curtain.

5. The open-front refrigerated display case of claim 4, wherein spillover airflow diverting device further comprises a damper configured to direct the spillover air between a first flow path for recycling the spillover air to the medium temperature air curtain and a second flow path for discharging the spillover air as the outer layer air curtain over the open front of the low temperature zone.

6. An open-front refrigerated display case, having a medium temperature zone disposed above a low temperature zone in a generally vertically-stacked arrangement, comprising:

a medium temperature-controlled space having a medium temperature air curtain arranged to flow across the open front of the medium temperature controlled space;

a first fan configured to draw at least a portion of the air from the medium temperature air curtain through a first intake and across a medium temperature cooling coil and through a medium temperature flow path for discharge through a first outlet to maintain operation of the medium temperature air curtain;

a low temperature-controlled space having a low temperature air curtain arranged to flow across the open front of the lower temperature-controlled space;

a spillover airflow-diverting device disposed between the medium temperature zone and the low temperature zone, the spillover airflow-diverting device configured to direct spillover air from the medium temperature air curtain in a direction away from the open front of the low temperature zone;

wherein the spillover airflow diverting device further comprises a damper configured to direct the spillover air between a first flow path for recycling the spillover air to the medium temperature air curtain and a second flow path for discharging the spillover air as at least a portion of the outer layer air curtain of the low temperature zone.

7. The open-front refrigerated display case of claim 6, wherein the spillover airflow-diverting device further comprises louvers configured to direct a gravity-induced flow of the spillover air in an outward direction away from the open front of the low temperature zone.

8. The open-front refrigerated display case of claim 6, wherein the spillover airflow-diverting device includes one or more fans configured to collect spillover air from the medium temperature air curtain and direct it in an outward direction away from the open front of the low temperature zone.

9. The open-front refrigerated display case of claim 6, wherein the spillover airflow-diverting device includes one or more fans configured to collect spillover air from the medium temperature air curtain and direct it over the open front of the low temperature zone as an outer layer air curtain.

10. The open-front refrigerated display case of claim 6, wherein the spillover airflow-diverting device includes one or more fans configured to collect the spillover air from the medium temperature air curtain and direct it across the medium temperature cooling coil and through the medium temperature flow path for discharge through the first outlet to recycle the spillover air and maintain operation of the medium temperature air curtain.

11. A method of making an open-front refrigerated display case, having a medium temperature zone disposed above a low temperature zone in a generally vertically-stacked arrangement, the method comprising:

providing a medium temperature-controlled space having a medium temperature air curtain arranged to flow across the open front of the medium temperature controlled space;

providing a first fan configured to draw at least a portion of the air from the medium temperature air curtain through a first intake and across a medium temperature cooling coil and through a medium temperature flow path for discharge through a first outlet to maintain operation of the medium temperature air curtain;

providing a low temperature-controlled space having a low temperature air curtain arranged to flow across the open front of the lower temperature-controlled space;

providing a spillover airflow-diverting device disposed between the medium temperature zone and the low temperature zone, the spillover airflow-diverting device configured to direct spillover air from the medium temperature air curtain in a direction away from the open front of the low temperature zone, wherein the spillover airflow-diverting device comprises at least one of (a) louvers configured to direct a gravity-induced flow of the spillover air in an outward direction away from the open front of the low temperature zone, and (b) a damper configured to direct the spillover air between a first flow path to the medium temperature air curtain and a second flow path that is at least one of (a) over the open front of the low temperature zone, and (b) away from the low temperature zone.

12. The method of claim 11, wherein the spillover airflow-diverting device includes one or more fans configured to collect spillover air from the medium temperature air curtain and direct it in an outward direction away from the open front of the low temperature zone.

13. The method of claim 11, wherein the spillover airflow-diverting device includes one or more fans configured to collect spillover air from the medium temperature air curtain and direct it over the open front of the low temperature zone as an outer layer air curtain.

14. The method of claim 11, wherein the spillover airflow-diverting device includes one or more fans configured to collect the spillover air from the medium temperature air curtain and direct it across the medium temperature cooling coil and through the medium temperature flow path for discharge through the first outlet to recycle the spillover air and maintain operation of the medium temperature air curtain.

* * * * *